US006883785B1

(12) United States Patent
Knapp

(10) Patent No.: US 6,883,785 B1
(45) Date of Patent: Apr. 26, 2005

(54) BRACKET FOR T-POST FENCE BRACES AND/OR GATES

(75) Inventor: David Mark Knapp, Mineral Point, WI (US)

(73) Assignee: New Farm Products, Inc., Mineral Point, WI (US)

( * ) Notice: Subject to any disclaimer, the term of this patent is extended or adjusted under 35 U.S.C. 154(b) by 25 days.

(21) Appl. No.: 10/622,719

(22) Filed: Jul. 18, 2003

Related U.S. Application Data

(60) Provisional application No. 60/399,757, filed on Jul. 30, 2002.

(51) Int. Cl.[7] ..... E04H 17/02
(52) U.S. Cl. ..... 256/10; 256/1; 256/32
(58) Field of Search ..... 256/35, 36, 32, 256/33, 19, 10, 63

(56) References Cited

U.S. PATENT DOCUMENTS

| | | | | |
|---|---|---|---|---|
| 4,239,414 A | | 12/1980 | Williamson | |
| 4,349,181 A | | 9/1982 | Asher et al. | |
| 4,582,300 A | | 4/1986 | Chappell | |
| 4,679,772 A | | 7/1987 | Peterson | |
| 4,682,761 A | | 7/1987 | Hanneken | |
| 4,688,769 A | | 8/1987 | Smrt | |
| 4,763,879 A | | 8/1988 | Wasicek et al. | |
| 4,792,122 A | | 12/1988 | Smrt | |
| 4,889,322 A | | 12/1989 | Wagner | |
| 4,923,176 A | | 5/1990 | Heinz | |
| 4,936,550 A | | 6/1990 | Wickham et al. | |
| 4,979,724 A | | 12/1990 | Williams | |
| 5,026,028 A | | 6/1991 | Ooi et al. | |
| 5,042,780 A | | 8/1991 | Yearwood | |
| 5,046,705 A | * | 9/1991 | Williams | 256/36 |
| 5,061,109 A | | 10/1991 | Miller | |
| 5,104,074 A | | 4/1992 | Malloy | |
| 5,192,055 A | | 3/1993 | Griggs et al. | |
| 5,203,817 A | | 4/1993 | Klumpjan | |
| 5,356,101 A | | 10/1994 | Malloy | |
| 5,435,097 A | * | 7/1995 | Harper | 47/43 |
| 5,460,344 A | | 10/1995 | Malloy | |
| 5,518,333 A | | 5/1996 | Cienkus, Jr. et al. | |
| 5,593,143 A | | 1/1997 | Ferrarin | |
| 5,653,546 A | | 8/1997 | Cronkhite et al. | |
| 6,705,598 B1 | * | 3/2004 | Collins | 256/35 |
| 2003/0066995 A1 | * | 4/2003 | Collins | 256/35 |

* cited by examiner

*Primary Examiner*—John R. Cottingham
(74) *Attorney, Agent, or Firm*—Craig A. Fieschko, Esq.; DeWitt Ross & Stevens S.C.

(57) ABSTRACT

The invention involves a T-post bracket allowing rapid and easy attachment of bracing T-posts to stanchion T-posts for fencing, trellis, or similar applications, and/or rapid and easy attachment of gates or other swinging structures to stanchion T-posts affixed to the bracket. The bracket has one end wherein a stanchion insertion space is provided between a stop member and a pair of retaining tabs, and insertion of a stanchion engagement fastener (e.g., a pin) engages the stanchion within the stanchion insertion space. Engagement legs may extend from the retaining tabs, and a bracing T-post may be fit between the engagement legs and pinned therein by insertion of brace engagement fasteners. Additionally or alternatively, a hinge post may extend from the bracket from a point about the stanchion insertion space, preferably from the stop member, to allow hanging of a gate or other swinging structure from the hinge post (and thus from a stanchion situated within the stanchion insertion space).

27 Claims, 2 Drawing Sheets

BRACKET FOR T-POST FENCE BRACES AND/OR GATES

CROSS-REFERENCE TO RELATED APPLICATIONS

This application claims priority under 35 USC §119(e) to U.S. Provisional Patent Application 60/399,757 filed 30 Jul. 2002, the entirety of which is incorporated by reference herein.

FIELD OF THE INVENTION

This disclosure concerns an invention relating generally to fences, fenced enclosures, and components thereof, and more specifically to components used in constructing fences and fenced enclosures from T-posts.

BACKGROUND OF THE INVENTION

In agricultural and other fields, fences often need to be built to contain animals. For the sake of speed and cost reduction, fences are often constructed using T-posts, which are posts having T-shaped cross-sections. These are driven into the ground to form fence stanchions (between which lengths of fencing wire are run), and/or bracing posts, which are joined to stanchion posts to help the stanchion posts withstand pulling from the ground. Bracing is particularly important for stanchions which define the ends or corners of fences, since these stanchions are generally not subject to balanced forces from fencing wire or other cross-members extending between stanchions. Gates are often hung from stanchion posts by installing hinges which allow beams, panels, or other gates to swing from the stanchion posts. Owing to the weight of the gates, it is usually important that gate-supportting stanchions be sturdily braced. Bracing can take the form of diagonal braces, wherein a bracing T-post extends downwardly at an angle from a stanchion T-post (generally to the ground); H-braces, wherein a bracing T-post extends horizontally from a stanchion T-post (generally to another stanchion T-post); or other forms.

However, constructing bracing arrangements is generally the most difficult and time-consuming aspect of fence-building, primarily since the structure of T-posts does not allow them to be readily fixed together at their ends or along portions of their lengths. Speedy and inexpensive bracing connections are desirable to reduce installation and maintenance burdens, but unfortunately most simple solutions—such as simply wiring the stanchions and braces together—generally does not provide sufficient strength for long-term durability. Several brackets and other bracing connections are commercially available, but these tend to suffer from flaws: they can be expensive; they may allow only a single type of bracing arrangement (e.g., they may only allow construction of H-braces), or a limited range of arrangements; they may only allow bracing in directions in which the stanchions are weaker (i.e., the bracing forces may be exerted in directions other than parallel to the height of the "T" of the T-post stanchion); they may be too weak for extended use, primarily because their lack of strength makes them serve as "weak links" along the fence; and/or they may interfere with desired gating configurations owing to their configuration and/or bulk.

SUMMARY OF THE INVENTION

The invention, which is defined by the claims set forth at the end of this document, is directed to methods and apparata which at least partially alleviate the aforementioned problems. A basic understanding of some of the preferred features of the invention can be attained from a review of the following brief summary of the invention, with more details being provided elsewhere in this document.

The invention involves a T-post bracket allowing rapid and easy attachment of bracing T-posts to stanchion T-posts, and/or for rapid and easy attachment of gates or other swinging structures to stanchion T-posts affixed- to the bracket. The bracket is adapted to be used with standard T-posts, i.e., with a T-post having a crossbar with opposing front and rear faces, and having a main bar extending generally centrally from the front face and spaced studs extending generally centrally from the rear face opposite the main bar. For sake of more rapid understanding by the reader, the following review of the bracket will make reference to the version of the bracket depicted in FIGS. 1 and 2, but it should be understood that the following review also applies in whole or substantial part to other versions of the bracket described later in this document.

The bracket (100) includes a stop member (106) having right and left sides and a midsection therebetween, wherein the stop member (106) at least partially bounds a T-post stanchion insertion space (102) wherein a T-post to be used as a stanchion (10A) may be inserted. Opposing retaining tabs (116) then each extend from one of the sides of the stop member (106) inwardly towards each other, and the retaining tabs (116) are spaced from the midsection of the stop member (106) by a portion of the T-post stanchion insertion space (102) (this portion being a T-post crossbar space (122) sized to receive the crossbar (12) of the inserted T-post stanchion) to partially bound the T-post stanchion insertion space (102). The retaining tabs (116) are also spaced from each other by a portion of the T-post stanchion insertion space (102), this portion being a T-post main bar space (124) sized to receive the main bar (16) of the inserted T-post stanchion. Thus, when a T-post is inserted within the T-post stanchion insertion space (102), the T-post crossbar (12) and studs (18) largely rest within the T-post crossbar space (122) between the retaining tabs (116) and stop member (106), and the main bar largely rests within the T-post main bar space (124) between the retaining tabs (116). Stanchion engagement fastener holes (126) are defined in the bracket between the retaining tabs (116) and the midsection of the stop member (106) and open onto the T-post stanchion insertion space (102), whereby a stanchion engagement fastener (128) may be inserted into the stanchion engagement fastener holes (126) to rest between the spaced studs (18) of the inserted T-post stanchion. Thus, with the inserted T-post stanchion (10A) restrained by the stop member (106) and the retaining tabs (116) from movement in planes perpendicular to the stanchion (10A), and the inserted stanchion engagement fastener (128) restraining the bracket from movement along the axis of the stanchion (10A), the bracket will be fixed on the stanchion (10A) for later installation of a bracing T-post (10B) and/or a gate (or other swinging structure).

For installation of a bracing T-post (10B), the bracket preferably further includes a pair of opposing engagement legs (120) on opposing sides of the T-post stanchion insertion space (102), with the engagement legs (120) being spaced by a brace post receiving slot (104) (which may open onto the T-post main bar space (124) of the T-post stanchion insertion space (102)). Each engagement leg (120) extends from one of the sides of the stop member (106) and terminates in a brace insertion end (108) opposite the stop member (106). Each engagement leg (120) bears one or more brace engagement fastener holes (132) defined therein between the brace insertion end (108) and the T-post stanchion insertion space (102) (most preferably between the brace insertion end (108) and the T-post crossbar space (122)). The brace engagement fastener holes (132) of the opposing engagement legs (120) are oppositely situated to accommodate brace engagement fasteners (134) extending between the engagement legs (120). As will be discussed later in this document, a T-post brace (10B) may then be inserted within the brace post receiving slot (104) and fasteners (134) may be inserted within the brace engagement fastener holes (132) to engage the brace to the bracket (and thus to any stanchion situated therein).

Each engagement leg (120) is preferably formed in two sections extending at angles to each other for rigidity, with an engagement leg top section (138) extending across the top of the bracket and an engagement leg side section (140) extending downwardly from the engagement leg top section (138). The brace post receiving slot (104) is preferably defined between the engagement leg top sections (138) with a width sized to receive the main bar (16) of the T-post brace (10B). Additionally, the engagement leg top sections (138) are preferably at least substantially coplanar, and extend from the retaining tabs (116) to their brace insertion ends (108). Most preferably, the engagement leg top sections (138) are formed integrally with the stop member (106) to extend coplanarly from the stop member (106) as a continuous surface. The brace engagement fastener holes (132) are defined within the opposing engagement leg side sections (140), which are preferably at least substantially parallel. Additionally, the stanchion engagement fastener holes (126) may be defined within the engagement leg side sections (140) between the T-post main bar space (124) and the stop member (106) so that a stanchion engagement fastener (128) may be inserted to extend between the engagement legs (120).

For installation of a gate, the bracket further includes a hinge post (114) extending therefrom, with the hinge post (114) preferably being oriented parallel to the axis of the stanchion insertion space (102) and perpendicular to the axes of inserted stanchion engagement fasteners (128). Most preferably, the hinge post (114) is provided as a rod which extends upwardly from the stop member (106). The bearing sleeve of a gate (not shown) may them be complementarily fit upon the hinge post (114) by simply slipping it onto the hinge post (114), thereby allowing the bearing sleeve and gate to swing about the axis of the hinge post (114).

Further advantages, features, and objects of the invention will be apparent from the following detailed description of the invention in conjunction with the associated drawings.

DETAILED DESCRIPTION OF PREFERRED VERSIONS OF THE INVENTION

Figure 1:
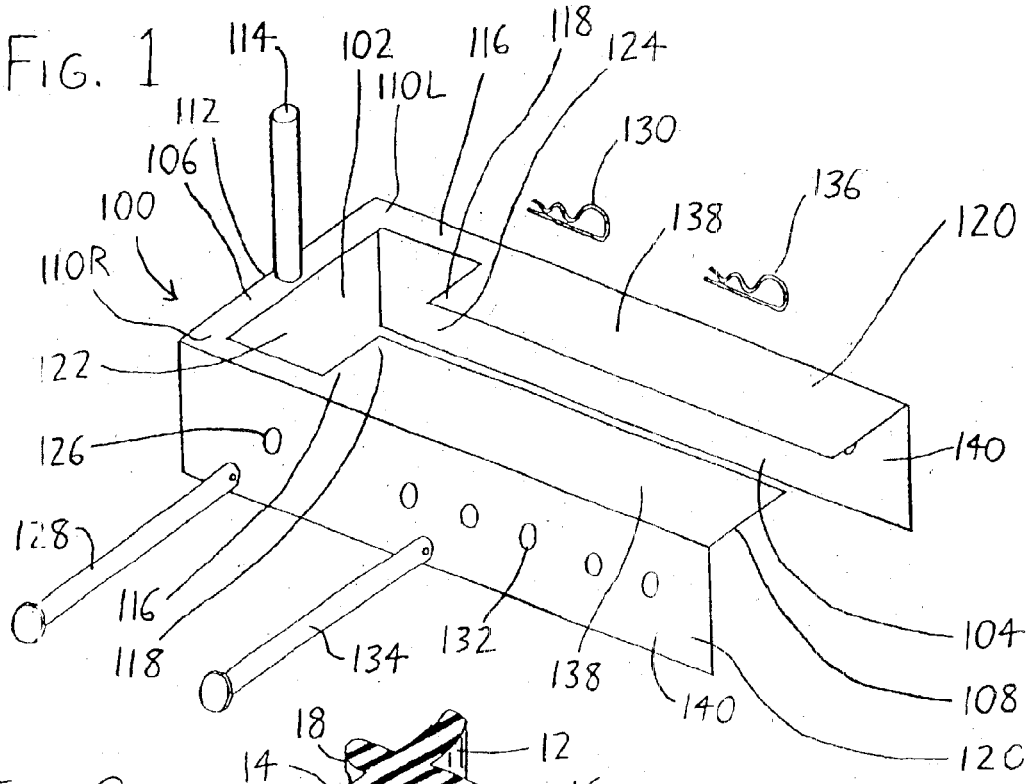
FIG. 1 is a perspective view of a first version of a T-post bracket 100 exemplifying the invention, shown without any T-posts installed and with stanchion engagement fasteners 128 and brace engagement fasteners 134 (and associated cotter pins 130 and 136) exploded from the bracket 100.
Figure 2:
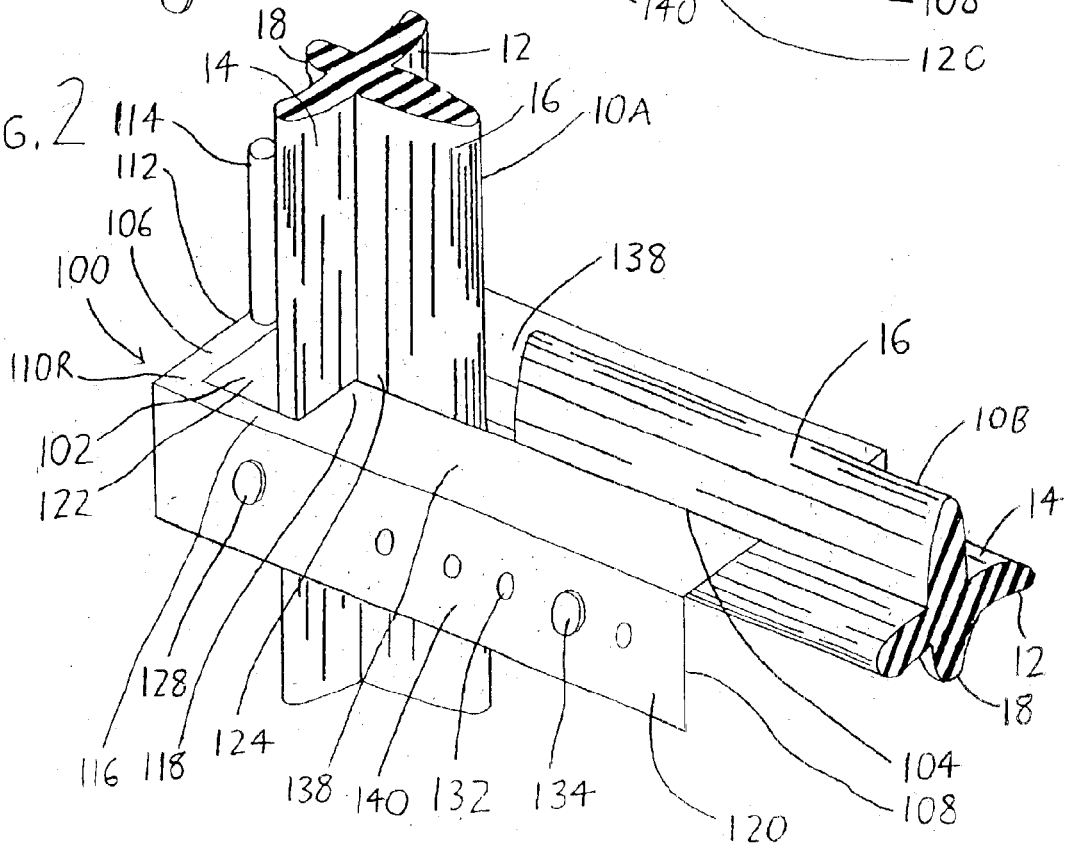
FIG. 2 is a perspective view of the T-post bracket 100 of FIG. 1 shown in an operational mode with a T-post stanchion 10A, a T-post brace 10B, and associated stanchion engagement fasteners 128 and brace engagement fasteners 134 installed.

Looking to FIGS. 1 and 2, a first particularly preferred version of the bracket is depicted generally by the reference numeral 100. The bracket 100 is shown uninstalled in a disassembled/exploded state in FIG. 1, and is shown assembled in an installed state as a T-post brace in FIG. 2 with a pair of T-posts 10A and 10B. Here, post 10A is a stanchion post (i.e., an at least substantially upright post) fit within a T-post stanchion insertion space 102 defined in the bracket 100, whereas post 10B is a bracing post (a post intended to resist tipping of the stanchion post 10A in one or more directions) installed in a T-post brace receiving slot 104 defined in the bracket 100. Both of the T-posts 10A and 10B have conventional (and preferably identical) T-post structures, including a cross bar 12 having a front cross bar face 14 and a rear cross bar face (not shown directly in the Figures); a main bar 16 extending from the front cross bar face 14; and a series of spaced studs 18 protruding from the rear cross bar face opposite the main bar 16. When the bracket 100 is used for bracing purposes, it will generally be used in conjunction with both a stanchion post 10A and a brace post 10B, whereas the bracket 100 might be used with only a stanchion post 10A when it is used as a gate hinge (though a brace post 10B will often be used as well). It is useful to first look in greater detail at the structure of the bracket 100 before further discussion of its uses and operation.

The bracket 100 has a length extending, between a stop member 106 and an opposing brace insertion end 108. The stop member 106 has opposing right and left sides 110R and 110L (which will collectively be referred to as sides 110), and a midsection 112 with a protruding hinge post 114. The stanchion post 10A is retained in the bracket 100 by a pair of opposing retaining tabs 116 which extend from the bracket sides 110 to bound (in conjunction with the stop member 106) the stanchion insertion space 102 and terminate in tab ends 118. The retaining tabs 116 are themselves defined on a pair of engagement legs 120 which extend from the bracket sides 110 to the brace insertion end 108 (or stated differently, the engagement legs 120 extend from the retaining tabs 116). The space between the opposing engagement legs 120 defines the brace receiving slot 104 wherein the brace post 10B is received and held.

Looking more specifically to FIG. 1 and the stanchion insertion space 102 used for retention of the stanchion post 10A, the stanchion insertion space 102 includes a T-post cross bar space 122 spacing the retaining tabs 116 from the stop member 106, and a T-post main bar space 124 defined between the opposing retaining tabs 116. As their names imply, the cross bar space 122 is sized to receive the cross bar 12 of the inserted stanchion post 10A (as well as its studs 18), whereas the main bar space 124 is provided as a slot-like aperture sized to closely receive the main bar 16 of the stanchion post 10A between the retaining tabs 116 without substantial lateral (right/left) play. The cross bar space 122 is simply defined as a rectangular aperture wherein the cross bar 12 of the inserted stanchion post 10A may be freely received when its main bar 16 is received within the T-post main bar space 124. In other words, the spacing between the stop member 106 and retaining tabs 116 is such that the cross bar 12 (and the studs 18 thereon) should freely slide within the T-post cross bar space 122 when the main bar 16 is received within the T-post main bar space 124.

Stanchion engagement fastener holes 126 are then defined in the bracket 100 on the opposing engagement legs 120, more particularly, in the portions of the opposing engagement legs 120 defining the retaining tabs 116. These stanchion engagement fastener holes 126 are located between the stop member 106 and the tab ends 118 of the retaining tabs 116 so that they open onto the cross bar space 122 of the stanchion insertion space 102. When the stanchion post 10A is inserted within the stanchion insertion space 102 such that its cross bar 12 rests within the cross bar space 122 and its main bar 16 rests within the T-post main bar space 124, the stanchion post 10A may be locked in place against further displacement within the stanchion insertion space 102 by inserting a stanchion engagement fastener 128 (such as a pin, bolt, or other elongated member) within opposing stanchion engagement fastener holes 126 and between adjacent studs 18 on the stanchion post 10A, with the stanchion engagement fastener 128 then being restrained from removal by addition of a fixture 130, such as a cotter pin or nut (if desired), at its end. Since the stanchion engagement fastener 128 then extends across the cross bar space 122 between adjacent studs 18 on the stanchion post 10A, the stanchion post 10A cannot translate within the stanchion insertion space 102 in planes parallel to the stanchion post 10A without its studs 18 interfering with the stanchion engagement fastener 128. Since the stanchion post 10A is also restrained from movement within the stanchion insertion space 102 in planes perpendicular to the stanchion post 10A by the stop member 106 and retaining tabs 116, the stanchion post 10A and bracket 100 will effectively be locked together by the stanchion engagement fastener 128. Thus, the bracket 100 will be fixed on the stanchion post 10A for later installation of the bracing T-post 10B, and/or the later installation of a gate or other swinging structure (not shown).

If installation of the bracing T-post 10B is desired, the main bar 16 of the bracing post 10B may be inserted within the brace receiving slot 104 spacing the engagement legs 120 so that the studs 18 of the bracing T-post 10B face downwardly. The opposing engagement legs 120 each bear opposing brace engagement fastener holes 132 between the brace insertion end 108 and the stanchion insertion space 102, more particularly, between the brace insertion end 108 and the T-post cross bar space 122 of the stanchion insertion space 102. One or more brace engagement fasteners 134 may then be inserted within the brace engagement fastener holes 132 so that the fasteners 134 rest within adjacent studs 18 of the bracing T-post 10B, withe the brace engagement fasteners 134 then being restrained from removal by addition of cotter pins 136 or similar fixtures (if desired). This will effectively lock the bracing T-post 10B to the bracket 100, since the bracing T-post 10B may not displace in directions along the brace receiving slot 104 without its studs 18 interfering with the brace engagement fastener(s) 134, and the bracing T-post 10B may not displace in other directions because it is sandwiched between the brace engagement fastener(s) 134 and the engagement legs 120. It is notable that the brace 100 (and any bracing T-post 10B thereon) may be pivoted to a variety of angles with respect to any stanchion T-post 10A, since the stanchion engagement fastener 128 largely serves to pivotally fix the bracket 100 to the stanchion 10A. As a result, a bracing T-post 10B can be set at a horizontal (as illustrated in FIG. 2), or can instead be set at a variety of diagonal angles, with the pivoting ability better allowing the bracing T-post 10B to accommodate the surrounding terrain.

It is notable that the brace receiving slot 104 is preferably defined as an extension of the T-post main bar space 124 of the stanchion insertion space 102, i.e., the brace receiving slot 104 preferably extends from the brace insertion end 108 to open upon the stanchion insertion space 102. This allows a bracing T-post 10B to be fit in the brace receiving slot 104 with its end in abutment with the stanchion T-post 10A in the stanchion insertion space 102, thereby transferring bracing forces from the bracing T-post 10B directly to the stanchion T-post 10A, rather than transferring the forces through the bracket 100. As a result, the bracket 100 is effectively imparted with greater bracing strength.

The bracket 100 of FIGS. 1 and 2 is beneficially configured in such a manner that it is readily formed of a single piece of sheet metal by application of appropriate cutting and bending steps, with the fasteners 128 and 134 (and the hinge post 114, if desired) possibly being added later. As best seen in FIG. 1, the engagement legs 120 are preferably formed in such a fashion that they extend from the stop member 106 in two sections 138 and 140 extending at angles to each other for rigidity. Initially, each engagement leg 120 includes an at least substantially planar engagement leg top section 138 which extends across the top of the bracket 100, with the T-post brace receiving slot 104 defined between the engagement leg top sections 138. An at least substantially planar engagement leg side section 140 then extends downwardly from each engagement leg top section 138. The engagement leg top sections 138 are formed integrally with the stop member 106 to extend at least substantially coplanarly with each other and with the stop member 106 from the retaining tabs 116 to the brace insertion ends 108, whereas the engagement leg side sections 140 extend parallel to each other along this length. The brace engagement fastener holes 132 are defined in the engagement leg side sections 140 between the brace insertion end 108 and the stanchion insertion space 102, and the stanchion engagement fastener holes 126 are defined between the T-post main bar space 124 and the stop member 106.

As previously noted, the hinge post 114 may be used where the bracket 100 is to be used for installation of a fence gate or other swinging structure. The hinge post 114 may be welded or otherwise affixed to the bracket 100 to extend upwardly, with the hinge post 114 most preferably taking the form of a rod welded to the stop member 106 to extend upwardly parallel to the axis of the stanchion insertion space 102 and perpendicular to the axes of inserted stanchion engagement fasteners 128. A gate or other swinging structure having a bearing sleeve may then be installed on the hinge post 114 by complementarily fitting it upon and over the hinge post 114, thereby allowing the bearing sleeve and gate (or other structure) to swing about the axis of the hinge post 114.

Figure 3:
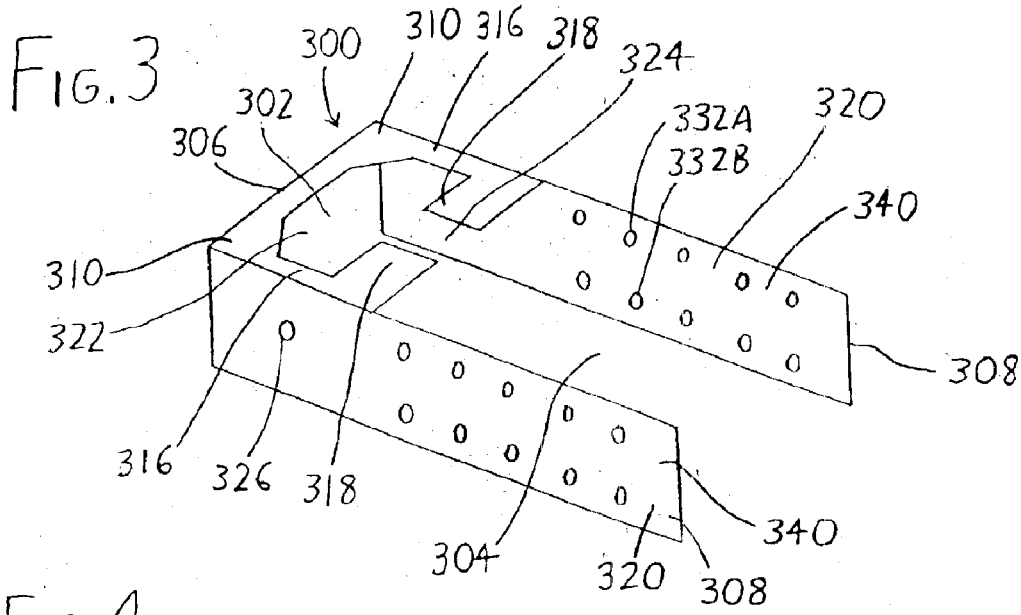
FIG. 3 is a perspective view of a second version of an exemplary T-post bracket 300 which is particularly adapted to serve as a bridge between T-post stanchions and braces, shown without any T-posts installed.

FIG. 3 then illustrates a second version of a bracket 300 which lacks any hinge post for installation of a gate or other swinging structure, with the bracket 300 therefore primarily being intended for bracing of a stanchion post (not shown in FIG. 3). The bracket 300 has structure for retaining a stanchion post which is similar to the stanchion-retaining structure of the bracket 100, and it includes a stop member 306 having opposing sides 310 from which retaining tabs 316 and engagement legs 320 extend, with the retaining tabs 316 being regarded as that structure which bounds (in conjunction with the stop member 306) the stanchion insertion space 302. The retaining tabs 316 extend inwardly to terminate in spaced opposing tab ends 318, whereas the engagement legs 320 terminate at brace insertion ends 308. The stanchion insertion space 302 includes a T-post cross bar space 322 spacing the retaining tabs 316 from the stop member 306, and a T-post main bar space 324 defined between the opposing retaining tabs 316. Here, the cross bar space 322 is defined as a semi-trapezoidal space which more complementarily receives the cross-section of an inserted stanchion post. Stanchion engagement fastener holes 326 are then defined on the portions of the opposing engagement legs 320 (more specifically, on portions defining the retaining tabs 316) between the stop member 306 and the tab ends 318 of the retaining tabs 316 so that they open across the T-post cross bar space 322 of the stanchion insertion space 302. Thus, when a stanchion post is inserted within the stanchion insertion space 302 such that its cross bar rests within the cross bar space 322 and its main bar rests within the T-post main bar space 324, the stanchion post may be fixed within the stanchion insertion space 302 by inserting a stanchion engagement fastener (not shown) within opposing stanchion engagement fastener holes 326 and between adjacent studs on the stanchion post. Since the stanchion post will then be sandwiched between the stanchion engagement fastener and the retaining tabs 316, with the stanchion engagement fastener situated between adjacent studs on the stanchion post the stanchion post cannot translate within the stanchion insertion space 302. The bracket 300 will therefore be fixed on the stanchion post for later installation of a bracing T-post. Thus, the stanchion-retaining portion of the bracket 300 is structurally similar to, and functionally identical to, the stanchion-retaining portion of the bracket 100.

However, the portion of the bracket 300 for retaining a brace post is somewhat different. The engagement legs 320 lack any engagement leg top sections corresponding to the engagement leg top sections 138 shown in FIGS. 1 and 2, and instead effectively only include only parallel engagement leg side sections 340 which extend from the lower portions of the retaining tabs 316 to the brace insertion ends 108. The space between the opposing engagement legs 320 defines the brace receiving slot 304 wherein the brace post is fixed. Brace engagement fastener holes are then formed in upper and lower rows 332A and 332B in the engagement legs 320 between the brace insertion end 308 and the retaining tabs 316. To install a bracing T-post (not shown), one or more brace engagement fasteners (not shown) may first be inserted within one of the rows of brace engagement fastener holes 332A or 332B, and a bracing T-post may be placed so that its main bar bears against the brace engagement fastener(s). One or more brace engagement fasteners (not shown) may then be inserted within the other of the rows of the brace engagement fastener holes 332B or 332A between the studs of the bracing T-post, thereby locking the bracing T-post in place between the engagement legs 320. Note that this arrangement allows the bracing T-post to be fixed within the bracket 300 and between the engagement legs 320 with its studs facing either upwardly or downwardly, whereas such studs 18 must face downwardly in the bracket 100. As with the bracket 100, the bracket 300 is to some degree pivotable about a stanchion T-post after being mounted thereon, thereby allowing any bracing T-post to be oriented at a variety of angles with respect to the stanchion T-post.

Figure 4:
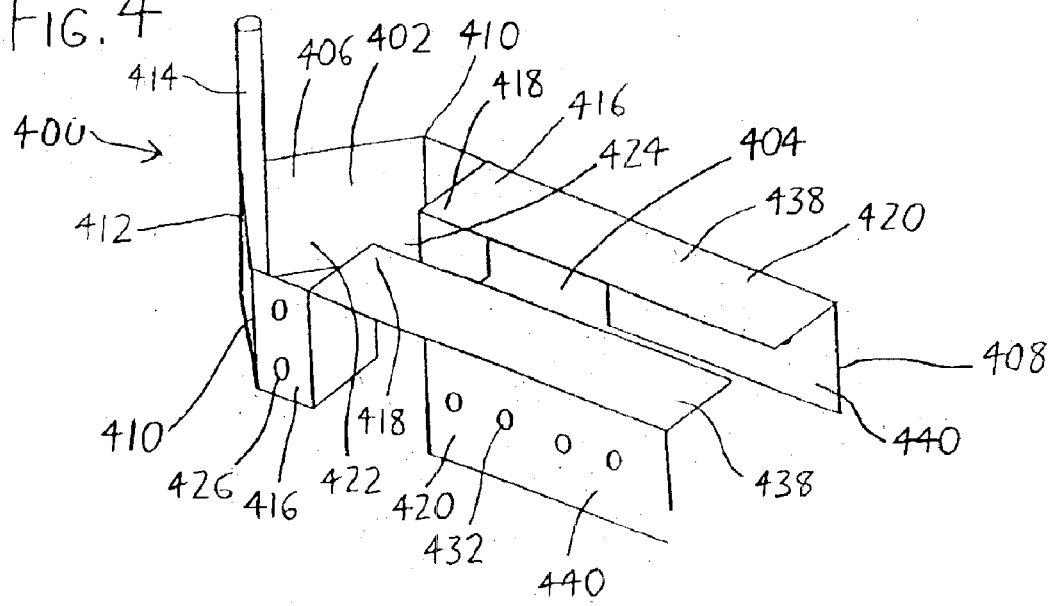
FIG. 4 is a perspective view of a third version of an exemplary T-post bracket 400 shown without any T-posts installed.

FIG. 4 then illustrates another exemplary bracket 400 illustrating further modifications that may be made to the brackets noted above. As with the bracket 300, the bracket 400 has a stanchion insertion space 402 which is shaped more complementary to the cross-section of a stanchion post, but here this is done by bending the stop member 406 at its midsection 412 about a protruding hinge post 414 (which is welded to the stop member 406 along the fold line at the midsection 412), and then having the retaining tabs 416 extend in parallel fashion from the sides 410 of the stop member 406 towards the brace insertion end 408 and then extend inwardly towards spaced opposing tab ends 418. The stanchion insertion space 402 therefore includes a T-post cross bar space 422 spacing the retaining tabs 416 from the stop member 406, and a T-post main bar space 424 defined between the opposing retaining tabs 416. Stanchion engagement fastener holes 426 are then defined on the raining tabs 416 between the stop member 406 and the tab ends 418 so that they open onto the cross bar space 422 of the stanchion insertion space 402. Thus, when a stanchion post (not shown) is inserted within the stanchion insertion space 402 such that its cross bar rests within the cross bar space 422 and its main bar rests within the T-post main bar space 424, the stanchion post may be fixed in place against further displacement within the stanchion insertion space 402 by inserting a stanchion engagement fastener (not shown) within opposing stanchion engagement fastener holes 426 and between adjacent studs on the stanchion post. Here, since the stop member 406 and retaining tabs 416 define downwardly-extending bands which engage a greater length of any inserted stanchion post, they will accommodate less tilting of the bracket 400 in planes about the perpendicular to the stanchion post. Noting that multiple stanchion engagement fastener holes 426 are provided along the heights of the retaining tabs 416 (and thus along the length of the cross bar space 422)—here, a pair of stanchion engagement fastener holes 426 are vertically spaced on each retaining tab 416—tilting can be further reduced if a pair of stanchion engagement fasteners (not shown) are inserted to rest on opposing sides of a stud on the stanchion post. Since the bracket 400 accommodates less tilting about its stanchion post, it is more suitable for bracing purposes when brace posts are to be affixed to stanchion posts at near-perpendicular angles. Owing to this feature, the bracket 400 is also well suited for gate installation since the hinge post 414 will be fixed at a near-vertical angle with respect to any stanchion post (which is usually the angle desired for gate installation).

Engagement legs 420 then extend from the retaining tabs 416, with planar engagement leg top sections 438 extending in spaced relationship across the top of the bracket 400 to define a brace receiving slot 404 wherein a brace post (not shown) may be fixed. Engagement leg side sections 440, which are preferably at least substantially planar, extend downwardly from the engagement leg top sections 438 in spaced parallel relation. Whereas the engagement leg top sections 438 resemble the engagement leg top sections 138 of FIGS. 1 and 2, with the engagement leg top sections 438 extending from the retaining tabs 416 to the brace insertion end 408, the engagement leg side sections 440 are spaced from the retaining tabs 416 (an arrangement which is not necessary, but which eases cutting and bending of the bracket 400 from a single piece of sheet metal, and which also allows the engagement legs 420 to be severed from the retaining tabs 416 more easily, as discussed below). Brace engagement fastener holes 432 are defined in the engagement leg side sections 440 so that when a main bar of a brace post (not shown) is installed within the brace receiving slot 404 with its studs facing downwardly, one or more brace engagement fasteners (not shown) may be installed through opposing brace engagement fastener holes 432 so that the fasteners rest between adjacent studs, thereby fixing the brace post within the brace receiving slot 404. Thus, a brace post may be installed within the bracket 400 in substantially the same manner as it would be installed in the bracket 100.

In some cases, it may be desirable to use brackets such as those described above solely for the purpose of installing a gate or other swinging structure, in which case the engagement legs (and the brace post receiving slot therebetween) are unnecessary. In such a circumstance, the bracket 400 is beneficial because the engagement legs 420 may be severed from the retaining tabs 416 by cutting along the seam between the engagement leg top sections 438 and the retaining tabs 416, or by bending along this seam until the seam breaks from metal fatigue. The engagement legs 402 may then be discarded and the remaining portion of the bracket 400 may simply be installed on a stanchion post in the manner previously noted so that the hinge post 414 may serve as an axle upon which a gate bearing may be fit, with any gate then swinging about the hinge post 414.

Figure 5:
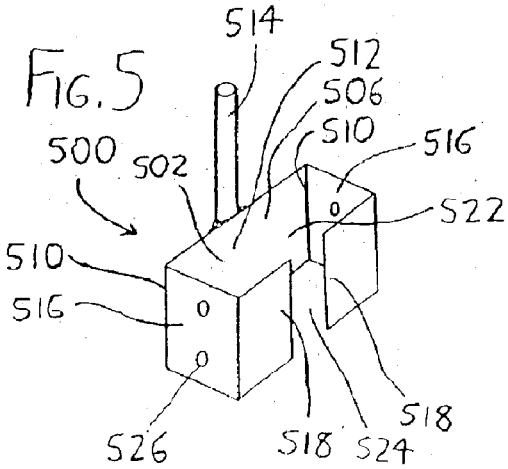
FIGS. 5 and 6 provide perspective views of additional exemplary versions of T-post brackets 500 and 600 which are particularly adapted to serve as hinges allowing connection of gates or other swinging structures to a T-post stanchion.
Figure 6:
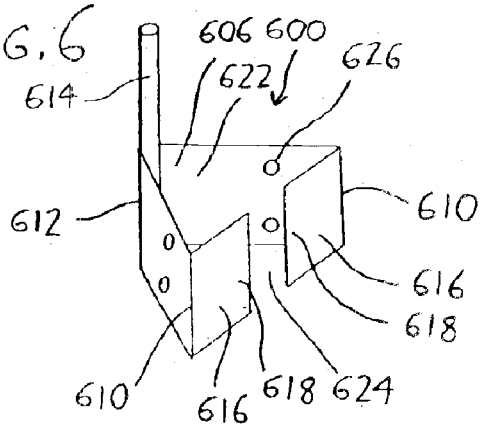

FIGS. 5 and 6 then illustrate alternative brackets 500 and 600 which simplify the structure of the foregoing brackets to make them more suitable for sole use as gate hinges. In FIG. 5, the bracket 500 is formed similarly to a combination of the brackets 100 and 400, but lacks engagement legs for mounting of a brace post. A stop member 506 has a midsection 512 with a protruding binge post 514 welded to its exterior, and opposing sides 510 from which retaining tabs 516 extend, initially away from the stop member 506 and then inwardly to terminate in tab ends 518. The area partially bounded by the stop member 506 and retaining tabs 516 defines a stanchion insertion space 502, with the stanchion insertion space 502 including a T-post cross bar insertion space 522 spacing the retaining tabs 516 from the stop member 506, and a T-post main bar insertion space 524 defined between the opposing retaining tabs 516. Stanchion engagement fastener holes 526 are then defined in the retaining tabs 516 between the stop member 506 and the tab ends 518 of the retaining tabs 516 so that they open onto the cross bar space 522 of the stanchion insertion space 502. Thus, as in the prior arrangements, when a stanchion post (not shown) is inserted within the stanchion insertion space 502 such that its cross bar rests within the cross bar space 522 and its main bar rests within the T-post main bar space 524, a stanchion engagement fastener (not shown) may be inserted within opposing stanchion engagement fastener holes 526 and between adjacent studs on the stanchion post to fix the bracket 500 in place on the stanchion post. The bracket 500 will then be fixed on the stanchion post, and a gate or other swinging structure having a bearing sleeve may then be installed on the hinge post 514 by complementarily fitting the bearing sleeve upon and over the hinge post 514, thereby allowing the bearing sleeve and gate (or other structure) to swing about the axis of the hinge post 514.

FIG. 6 then shows another variation wherein the stop member 606 has a bent midsection 612 with a protruding hinge post 614 welded to its interior at the fold, and opposing sides 610 from which retaining tabs 616 extend inwardly towards each other to terminate in tab ends 618. As in prior versions, a stanchion insertion space 602 is defined by the area bounded by the stop member 606 and retaining tabs 616, with a T-post cross bar insertion space 622 spacing the retaining tabs 616 from the stop member 606 and a T-post main bar insertion space 624 defined between the opposing retaining tabs 616. Stanchion engagement fastener holes 626 are defined in the bracket 600 between the retaining tabs 616 and the midsection 612 of the stop member 606 to open onto the T-post cross bar insertion space 622. As in the prior arrangements, a stanchion post (not shown) may therefore be inserted within the stanchion insertion space 602 such that its cross bar rests within the cross bar insertion space 622 and its main bar rests within the T-post main bar insertion space 624, and one or more stanchion engagement fasteners (not shown) may then be inserted within opposing stanchion engagement fastener holes 626 and between adjacent studs on the stanchion post to fix the bracket 600 in place on the stanchion post. A gate or other swinging structure having a bearing sleeve may then be installed on the hinge post 614.

It should be understood that various terms referring to orientation and position are used throughout this document—e.g., "front" (as in "front cross bar face 14"), "rear" (as in "rear cross bar face"), "right" (as in "right bracket side 110R"), "left" (as in "left bracket side 110L"), "top" (as in "engagement leg top section 138"), and "side" (as in "engagement leg side section 140")—are relative terms rather than absolute ones. In other words, it should be understood (for example) that the right bracket side 110R may in fact be located at the left of the apparatus, or the engagement leg top section 138 may in fact be located at the side of the apparatus, depending on the overall orientation of the apparatus and the position of the observer. Thus, such terms should be regarded as words of convenience, rather than limiting terms.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A T-post bracket adapted to be received on an elongated T-post having a crossbar with opposing front and rear faces, with a main bar extending generally centrally from the front face and studs extending generally centrally from the rear face opposite the main bar, the studs being spaced along at least a portion of the length of the crossbar, the bracket comprising:

a. a stop member having right and left sides, and a midsection therebetween;

b. opposing retaining tabs with:

(1) one retaining tab extending from the right side of the stop member and the other retaining tab extending from the left side of the stop member, and (2) the retaining tabs being:

(a) spaced from the stop member by a T-post crossbar space sized to receive a crossbar of an inserted T-post, and (b) spaced from each other by a T-post main bar space sized to receive a main bar of an insert T-post; and c. opposing stanchion engagement fastener holes defined between the retaining tabs and the midsection of the stop member, wherein a stanchion engagement fastener may be inserted into the stanchion engagement fastener holes to rest between spaced studs of an inserted T-post;

d. a pair of engagement legs spaced by a brace post receiving slot opening onto a T-post main bar space, wherein the engagement legs have opposing brace engagement fastener holes defined therein.

2. The T-post bracket of claim 1 further comprising a hinge post extending from the stop member.

3. The T-post bracket of claim 2 wherein the hinge post is oriented in a direction at least substantially perpendicular to an axis defined between opposing stanchion engagement fastener holes.

4. The T-post bracket of claim 1 wherein each engagement leg is defined by:

(1) an at least substantially planar engagement leg side section, and (2) an at least substantially planar engagement leg top section, wherein:

a. the brace engagement fastener holes are defined within the engagement leg side sections, b. the engagement leg top sections are at least substantially coplanar.

5. The T-post bracket of claim 4 wherein the stop number is at least substantially coplanar with the engagement leg top sections.

6. The T-post bracket of claim 4 wherein the engagement leg top sections each extend from one of the retaining tabs.

7. The T-post bracket of claim 4 wherein the engagement leg side sections are at least substantially parallel.

8. The T-post bracket of claim 4 wherein the right and left sides of the stop members are each joined to one of the engagement legs.

9. The T-post bracket of claim 8 wherein the stanchion engagement fastener holes are defined within the engagement legs.

10. A T-post bracket adapted to be received on an elongated T-post having:

(i) a crossbar with opposing front and rear faces, (ii) a main bar extending along the front face, and (iii) paced studs protruding from the rear face opposite the main bar, the bracket comprising:

a. a stop member having opposing right and left sides, and a midsection therebetween;

b. a pair of opposing engagement legs, each extending from one of the right and left sides of the stop member to terminate in a brace insertion end opposite the stop member;

c. a T-post stanchion insertion space defined in the bracket between the engagement legs, the T-post stanchion insertion space being partially bounded by the stop member and being sized to receive an inserted T-post;

d. one or more stanchion engagement fastener holes defined in the bracket and opening onto the T-post stanchion insertion space, the stanchion engagement fastener holes being oppositely situated to allow receipt of a stanchion engagement fastener extending between the engagement legs and across the T-post stanchion insertion space;

e. one or more bracket engagement fastener holes defined in each of the opposing engagement legs between the T-post stanchion insertion space and the brace insertion end, the brace engagement fastener holes being oppositely situated to accommodate a brace engagement fastener extending between the engagement legs and between the spaced studs of the inserted T-post.

11. The T-post bracket of claim 10 further comprising opposing retaining tabs, each extending inwardly from one of the sides of the stop member and partially bounding the T-post stanchion insertion space, wherein the engagement legs each extend from one of the retaining tabs.

12. The T-post bracket of claim 10 wherein the stanchion engagement fastener holes are defined in the engagement legs.

13. The T-post bracket of claim 10 wherein each engagement leg is defined by:

(1) an engagement leg top section, and (2) an engagement leg side section extending downwardly from the engagement leg top section, wherein:

a. the brace engagement fastener holes are defined within the engagement leg side sections, b. the engagement leg top sections are at least substantially coplanar.

14. The T-post bracket of claim 13 wherein the stop member is at least substantially coplanar with the engagement leg top sections.

15. The T-post bracket of claim 13 further comprising opposing retaining tabs, each extending inwardly from one of the sides of the stop member and partially bounding the T-post stanchion insertion space, wherein the engagement leg top sections each extend from one of the retaining tabs.

16. The T-post bracket of claim 13 wherein the engagement leg side sections are at least substantially parallel.

17. The T-post bracket of claim 13 wherein the right and left sides of the stop members are each joined to one of the engagement legs.

18. The T-post bracket of claim 10 further comprising a pair of retaining tabs, each extending inwardly from one of the engagement legs, the retaining tabs being:

a. spaced from the stop member by a T-post crossbar space defining a portion of the T-post stanchion insertion space, the T-post crossbar space being sized to receive a crossbar of an inserted T-post, and b. spaced from each other by a T-post main bar space defining a portion of the T-post stanchion insertion space, the T-post main bar space being sized to receive a main bar of an inserted T-post.

19. The T-post bracket of claim 10 further comprising a hinge post extending from the stop member.

20. A T-post bracket adapted to be received on an elongated T-post, the T-post having a length defined by:

(i) a crossbar with opposing front and rear face, (ii) a main bar extending from the front face, and (iii) spaced studs extending from the rear face opposite the main bar, the bracket comprising:

a. a stop member having right and left sides, and a midsection therebetween;

b. a pair of opposing engagement legs, each extending from one of the right and left sides of the stop member to terminate in a brace insertion and opposite the stop member, and each engagement leg including:

(1) a raining tab spaced from the stop member, wherein the retaining tabs of the opposing engagement legs are spaced:

(a) from each other by a T-post main bar space to receive a main bar of a inserted first T-post, and (b) from the stop member by a T-post crossbar space sized to receive a crossbar of such inserted first T-post;

(2) one or more stanchion engagement fastener holes defined therein between the T-post main bar space and the stop member, wherein the stanchion engagement fastener holes of the opposing engagement legs are oppositely situated to accommodate a stanchion engagement fastener extending between the engagement legs; and (3) one or more brace engagement fastener holes defined therein between the T-post crossbar space and the brace insertion end, wherein the brace engagement fastener holes of the opposing engagement legs are oppositely situated to accommodate a brace engagement fastener extending between the engagement legs.

21. The T-post bracket of claim 20 wherein the engagement legs each include:

(1) an engagement leg section, and (2) an engagement leg side section extending downwardly from the engagement leg top section, where the brace engagement fastener holes are defined in the engagement leg side sections.

22. The T-post bracket of claim 21 wherein the stanchion engagement fastener holes are defined in the engagement leg side sections.

23. The T-post bracket of claim 21 wherein a. the engagement leg top sections are at least substantially coplanar, and b. the engagement leg side sections are at least substantially parallel.

24. The T-post bracket of claim 21 wherein the retaining tabs define portions of the engagement leg side sections and extend coplanarly therefrom.

25. The T-post bracket of claim 20 wherein the T-post main bar space extends from the retaining tabs to the brace insertion end.

26. The T-post bracket of claim 20 further comprising a hinge post extending from the stop member.

27. A T-post bracket for mounting on an elongated T-post, the T-post having a crossbar with opposing front and rear faces, a main bar extending generally centrally from the front face, and studs extending generally centrally from the rear face opposite the main bar, the studs being spaced along the crossbar, the bracket comprising:

a. a stop member extending between opposing right and left sides;

b. a hinge post extending upwardly from the stop member;

c. a pair of opposing retaining tabs, each extending from one of the opposing sides of the stop member and terminating in a tab end, the tab ends being:

(a) spaced from the stop member by a T-post crossbar space sized to receive a crossbar of an inserted T-post, and (b) spaced from each other by a T-post main bar space sized to receive a main bar of such inserted T-post; and d. opposing stanchion engagement fastener holes defined between the tab ends and the hinge post, wherein a stanchion engagement fastener may be inserted into the stanchion engagement fastener holes to rest between spaced studs of an inserted T-post.

* * * * *

UNITED STATES PATENT AND TRADEMARK OFFICE

CERTIFICATE OF CORRECTION

PATENT NO. : 6,883,785 B1
DATED : April 26, 2005
INVENTOR(S) : Knapp, David Mark It is certified that error appears in the above-identified patent and that said Letters Patent is hereby corrected as shown below:

Column 9,
Line 24, delete "binge" and substitute therefor -- hinge --.

Column 11,
Line 9, delete "number" and substitute therefor -- members --.
Line 26, delete "paced" and substitute therefor -- spaced --.
Line 46, delete "bracket" and substitute therefor -- brace --.

Column 12,
Line 39, delete "and" and substitute therefor -- end --.

Column 13,
Line 12, delete "side" and substitute therefor -- top --.

Signed and Sealed this

Twelfth Day of July, 2005

JON W. DUDAS
*Director of the United States Patent and Trademark Office*